US005870021A

United States Patent [19]

Gadonniex

[11] Patent Number: 5,870,021

[45] Date of Patent: Feb. 9, 1999

[54] ANNEALING MAGNETIC ELEMENTS FOR STABLE MECHANICAL PROPERTIES

[75] Inventor: Dennis Michael Gadonniex, Delray Beach, Fla.

[73] Assignee: Sensormatic Electronics Corporation, Boca Raton, Fla.

[21] Appl. No.: 673,927

[22] Filed: Jul. 1, 1996

[51] Int. Cl.[6] ..... G08B 13/187

[52] U.S. Cl. ..... 340/551; 148/561; 148/DIG. 3; 148/DIG. 22; 148/DIG. 71; 340/572; 420/125; 420/590

[58] Field of Search ..... 340/551, 572; 148/561, DIG. 3, DIG. 22, DIG. 71; 420/125, 590

[56] References Cited

U.S. PATENT DOCUMENTS 4,510,489 4/1985 Anderson, III et al. ..... 340/551
4,510,490 4/1985 Anderson, III et al. ..... 340/572
5,252,144 10/1993 Martis ..... 148/121
5,351,033 9/1994 Liu et al. ..... 340/572
5,684,459 11/1997 Liu et al. ..... 340/572

*Primary Examiner*—Glen Swann
*Attorney, Agent, or Firm*—Robin, Blecker & Daley

[57] ABSTRACT

A control element for a magnetomechanical EAS marker is formed of an amorphous metalloid that has been annealed so as to be at least partially crystallized while remaining substantially flat. The annealing is preferably a two-stage process applied to induce semi-hard magnetic characteristics in an amorphous metallic material that is magnetically soft as cast. The two stages include a first stage in which the material is annealed for at least one hour at a temperature that is below a crystallization temperature of the material. The first stage results in a reduction in the volume of the material. The second stage is carried out at a temperature that is above the crystallization temperature and for a time sufficient to crystallize the bulk of the material and give it semi-hard magnetic properties. The two-stage annealing process prevents deformation of the material which has resulted from conventional crystallization processes.

28 Claims, 2 Drawing Sheets

ANNEALING MAGNETIC ELEMENTS FOR STABLE MECHANICAL PROPERTIES

BACKGROUND OF THE INVENTION

This invention relates to magnetic elements and, in particular, to semi-hard magnetic elements and methods of making same.

As used herein, the term semi-hard magnetic element means a magnetic element having semi-hard magnetic properties which are defined herein as a coercivity in the range of about 10–500 Oersted (Oe) and a remanence, after removal of a DC magnetization field which magnetizes the element substantially to saturation, of about 6 kilogauss (kG) or higher. Semi-hard magnetic elements having these semi-hard magnetic properties have been used in a number of applications. In one particular application, the elements serve as control elements for markers in a magnetic electronic article surveillance (EAS) system. A magnetic marker of this type is disclosed, for example, in U.S. Pat. No. 4,510,489.

In the marker of the '489 patent, a semi-hard magnetic element is placed adjacent to a magnetostrictive amorphous element. By magnetizing the semi-hard magnetic element substantially to saturation, the resultant remanence magnetic induction of the magnetic element arms or activates the magnetostrictive element so that it can magnetically resonant or vibrate at a predetermined frequency in response to an interrogating magnetic field.

This mechanical vibration results in the magnetostrictive element generating a magnetic field at the predetermined frequency. The generated field can then be sensed to detect the presence of the marker. By demagnetizing the semi-hard magnetic element, the magnetostrictive element is disarmed or deactivated so that it can no longer mechanically resonate at the predetermined frequency in response to the applied field. This type of marker is sometimes referred to as a "magnetomechanical" marker, and the corresponding EAS system is referred to as a magnetomechanical EAS system.

A technique for producing low-cost semi-hard magnetic elements usable as control elements in magnetomechanical markers was disclosed in U.S. Pat. No. 5,351,033, which is commonly assigned with the present application. According to the disclosure of the '033 patent, amorphous metalloid materials, such as Metglas® 2605TCA and 2605S2, which have soft magnetic properties as cast, are processed so that the materials develop semi-hard magnetic properties. The process disclosed in the '033 patent includes cutting the as-cast amorphous alloy ribbons into discrete strips and then annealing the strips so that at least a part of the bulk of the strips is crystallized.

When amorphous alloy strips are treated in accordance with the teachings of the '033 patent, there is a reduction in volume that accompanies the transition from an amorphous phase to a crystalline phase. In general, the reduction in volume is anisotropic, and as a consequence, the alloy strips are subjected to warping which leaves the strips in a deformed or "rippled" condition.

There are a number of disadvantages which result from the rippled shape of the processed strips. Among these are difficulties in handling the strips and packaging the strips to form the EAS markers. Further, if the magnetic elements are used as control elements in their rippled condition, there are variations from element to element in terms of the effective bias field provided by the control element, which results in variations in the resonant frequency of the assembled markers. This can adversely affect the performance and reliability of the markers.

OBJECTS AND SUMMARY OF THE INVENTION

It is an object of the invention to provide low-cost control elements for magnetomechanical EAS markers by crystallizing soft magnetic amorphous alloy strips.

It is a further object of the invention to perform the crystallization process in a manner which substantially avoids dimensional deformation of the alloy strips.

In accordance with the principles of the present invention, the above and other objectives are realized by providing a ribbon-shaped discrete magnetic element formed of an amorphous metalloid that has been annealed so as to be partially crystallized while remaining substantially flat.

According to another aspect of the invention, there is provided a method of making a magnetic element including the steps of providing a magnetic element formed of a magnetically soft amorphous metallic material, first-annealing the amorphous material for at least one hour at a temperature that is below a crystallization temperature of the material, and, after the first-annealing step, second-annealing the amorphous material for a time and at a temperature sufficient to crystallize the bulk of the material to give the overall magnetic material semi-hard magnetic properties.

The above-summarized process may be carried out with respect to a material having the designation Metglas® 2605SB1, where the first-annealing is performed at a temperature of about 485° C. and the second-annealing is carried out at a temperature in excess of 6000° C.

According to another aspect of the invention, there is provided a method of making a magnetic element including the steps of providing a magnetic element formed of a magnetically soft amorphous metallic material, heating the amorphous material from room temperature to an annealing temperature that is above a crystallization temperature of the material, with the heating being performed such that the rate at which the temperature of the material is increased never exceeds 0.265° C./sec, and then annealing the amorphous material at the annealing temperature for a time sufficient to crystallize the bulk of the material to give the overall magnetic material semi-hard magnetic properties.

By using the foregoing processes, a control element for a magnetomechanical marker can be formed by heat-treating a flat strip of soft magnetic amorphous alloy in a manner that preserves the dimensional stability of the material and results in finished control elements that are substantially flat. The control elements produced in accordance with the invention can then be easily packaged in markers having a flat configuration and magnetic properties that do not significantly vary from marker to marker.

BRIEF DESCRIPTION OF THE DRAWINGS

The above and other features, aspects and advantages of the present invention will become more apparent upon reading the following detailed description in conjunction with the accompanying drawings, in which.

DETAILED DESCRIPTION

Figure 1:
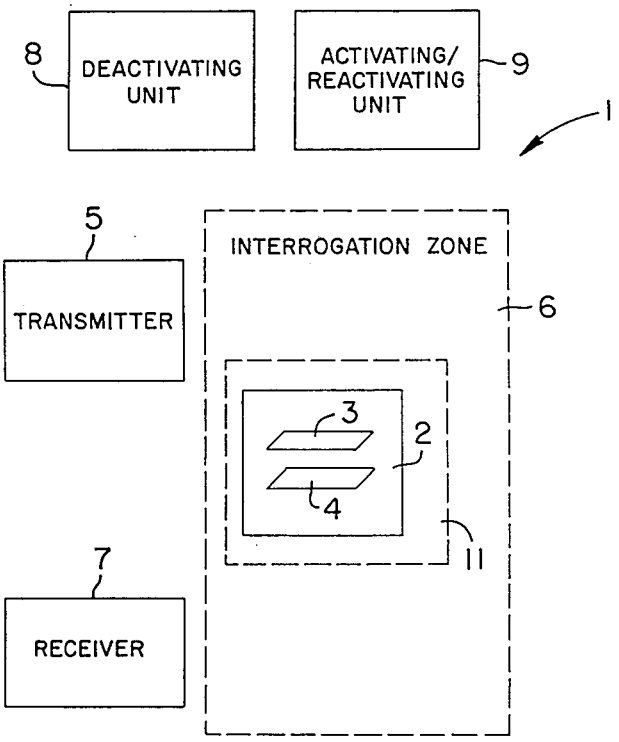
FIG. 1 shows an EAS system using a magnetic marker including a semi-hard magnetic element produced in accordance with the principles of the present invention.

FIG. 1 illustrates a magnetomechanical EAS system 1 in which the presence of an article 11 in an interrogation zone 6 is detected by sensing a marker 2 attached to the article. The marker 2 includes a semi-hard magnetic element 3 designed in accordance with the principles of the present invention. The semi-hard magnetic element 3 is used to activate and deactivate an adjacent signal generating element 4 of the marker 2. The signal generating element 4 can be an amorphous magnetostrictive element as described in the aforementioned '489 patent or as described in U.S. Pat. No. 5,568,125, issued Oct. 22, 1996.

The EAS system 1 further includes a transmitter 5 which transmits an AC magnetic field into the interrogation zone 6. The presence of the marker 2 and, thus, the article 11 in the interrogation zone 6 is detected by a receiver 7 which detects a signal generated by the interaction of the signal generating element 4 of the marker 2 with the transmitted magnetic field.

By placing the semi-hard element 3 in a first magnetic state (magnetized), the signal generating element 4 of the marker can be enabled and placed in an activated state so that it interacts with the applied field to generate a signal. Then, by changing the magnetized state of the element 3 (from magnetized to demagnetized), the signal generating element 4 is disabled and placed in a deactivated state so that it no longer interacts with the field to generate a signal. In this way, the marker 2 can be activated, deactivated and reactivated as desired in a deactivating unit 8 and an activating/reactivating unit 9.

EXAMPLE

An illustrative example of the principles of the present invention will now be described. The material processed in this example is commercially available from AlliedSignal Corp. under the designation 2605SB1. This material is believed to be composed exclusively of iron, silicon and boron. The material is obtained from AlliedSignal in the form of a long thin amorphous metalloid ribbon, wound on a reel, and having a width of about 11.45 millimeters and a thickness of about 50.8 microns (2 mils).

Figure 2:
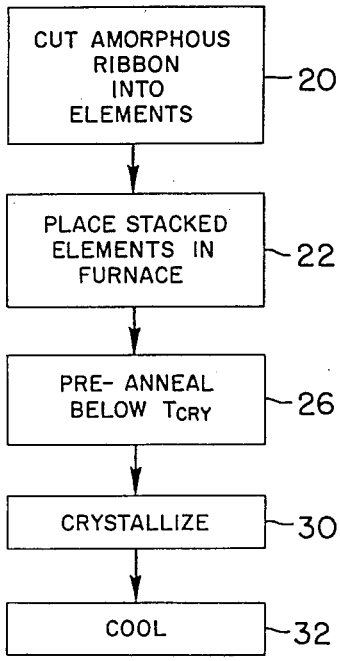
FIG. 2 shows a flow diagram of the processing steps applied to an amorphous metalloid material to form the semi-hard magnetic element of the invention.

The processing steps performed in accordance with this example are illustrated in FIG. 2, and include an initial step 20, in which the continuous ribbon of as-cast material is cut into discrete strips. Each cut is preferably made at an angle of 90° to the longitudinal axis of the continuous ribbon, to produce discrete strips having a rectangular shape. The distance between the cuts is such as to produce strips each having a tip-to-tip length of about 38.1 mm. The width of the discrete strips, taken normal to the longest side of the discrete strip, is the same as the width of the continuous ribbon, i.e. 11.45 mm.

The cut strips are then arranged for convenient handling and placed in a furnace that is initially at room temperature (step 22). The elements in the furnace are heated to a temperature below the crystallization temperature for the material and are maintained at that temperature for a period of one hour, as indicated at 24 in FIG. 3 and represented by step 26 in FIG. 2. This initial heat treatment step will sometimes be referred to as "pre-annealing".

For the SB1 material, the crystallization temperature $T_{CRY}$ is about 545° C., and a preferred temperature for the pre-annealing is about 485° C.

During the pre-annealing at step 26, the elements experience a reduction in volume that is rather gradual and substantially isotropic, and dimensional stability is maintained, so that the elements remain substantially flat. It has been found that this step produces a reduction of about 0.65 percent (0.0065) in the length of the elements.

Figure 3:
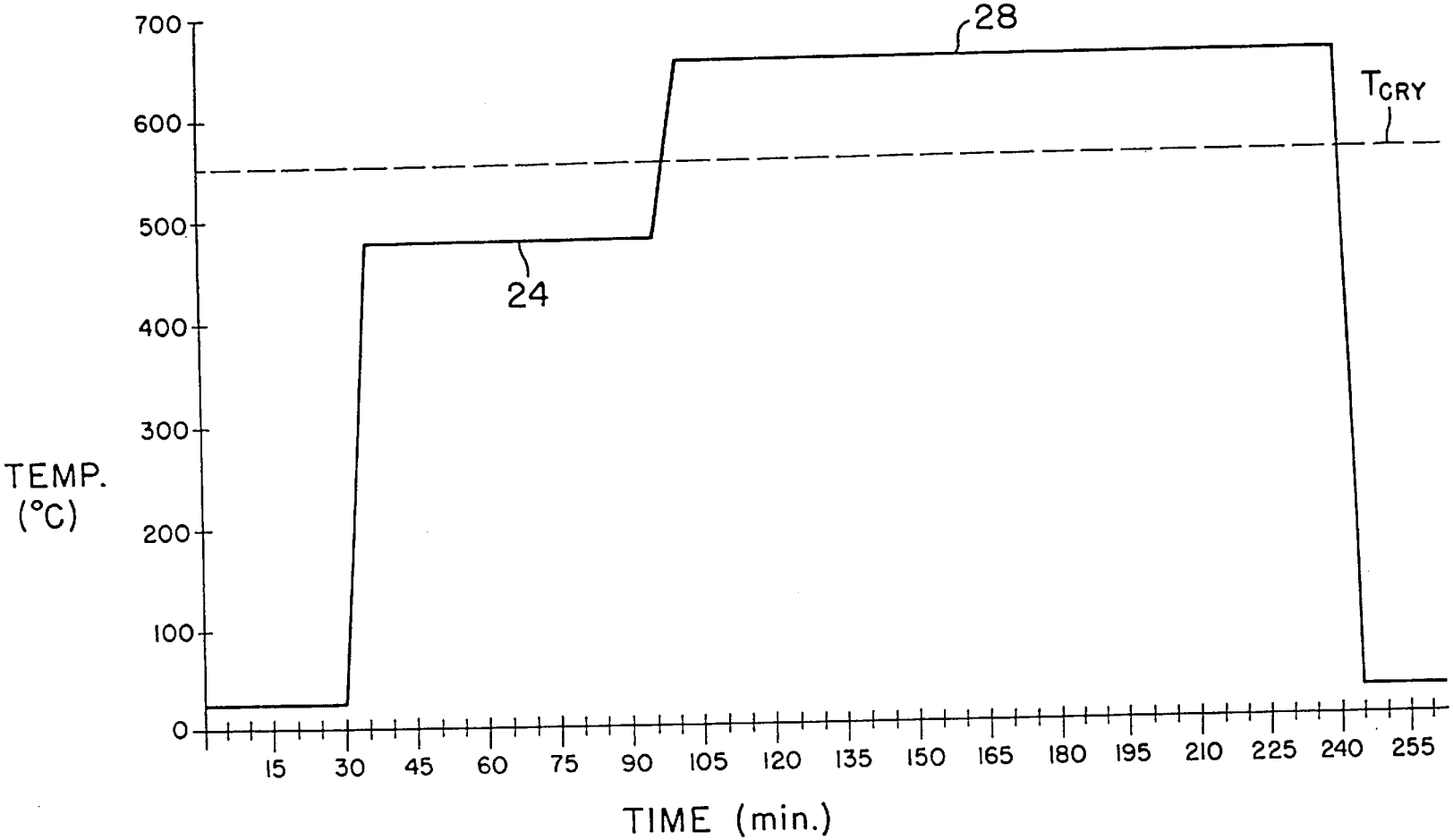
FIG. 3 is a graph which illustrates heat treating steps that are a part of the process of FIG. 2.

After the pre-annealing, the heat treatment continues at a temperature above $T_{CRY}$, as indicated at 28 in FIG. 3 and represented by step 30 in FIG. 2. The treatment above the crystallization temperature is carried out for a length of time and at a temperature sufficient to obtain desired semi-hard magnetic properties by crystallizing some or all of the bulk of the elements. In the particular example shown in FIG. 3, the crystallization step lasts about two and one half hours and is performed at a temperature of about 650° C. During this time, the elements experience further reduction in volume, but only to a modest extent, and without the warping or deformation that characterized prior art crystallization processes.

At the end of the crystallization step 30, the elements are cooled to room temperature (step 32, FIG. 2).

The process described in the above example produces control elements for magnetomechanical markers at low cost and with a geometric profile that is substantially flat and free of the deformation or rippling produced by previously known processing methods. The resulting elements can be conveniently handled and incorporated in compactly-packaged markers. In addition, the resulting control elements reliably provide predictable bias field levels when magnetized to saturation, and the markers in which the control elements are used have a resonant frequency that is not subject to variation due to variations in the bias field provided by the control element.

The particular parameters of the Example given above can be varied in a number of respects while still achieving the desired dimensional stability of the processed control elements. For example, it is believed that the pre-annealing can be carried out at various temperatures above 450° C. and below the crystallization temperature $T_{CRY}$ of 545° C. A preferred range for the pre-annealing is about 485°–520° C. It is believed that the pre-annealing step must be maintained for at least one hour to provide the desired dimensional stability. Continuing the pre-annealing for more than one hour is contemplated. In any case, it is believed that a reduction in volume of the material sufficient to shrink the longest dimension by about 0.65 percent should be accomplished prior to crystallization in order to prevent warping.

It is also contemplated to apply the principles of the present invention to materials other than the SB1 material. For example, a process of pre-annealing, followed by at least partial crystallization, could be applied to the 2605TCA and 2605S2 materials discussed in the '033 patent referred to above. Application of this process to other soft magnetic amorphous alloys is also contemplated.

For materials other than the SB1 material, a modest amount of experimentation may be required to establish appropriate parameters for the pre-annealing and crystallization stages. In any event, the pre-annealing should be carried out at a temperature below the crystallization temperature for the material in question. It is believed that a temperature of at least 400° C. and a duration of at least one hour are minimum parameters for the pre-annealing step if dimensional stability is to be achieved. The temperature and duration of the crystallizing stage will depend upon both the crystallization temperature of the material and the specific magnetic properties that are desired to be induced in the material.

In the specific Example described above, the cut magnetic elements were pre-annealed by being maintained at a temperature above 450° C. and below the crystallization temperature for a period of at least one hour. However, it is believed that satisfactory results could also be obtained by performing the pre-annealing in an alternative manner. According to this alternative, the material is gradually heated from room temperature to the temperature above $T_{CRY}$ at which the crystallization treatment stage is to be performed. If the heating from room temperature to the crystallization treatment temperature occurs slowly enough, it is believed that a pre-shrinkage in the material takes place before crystallization, and the undesirable dimensional deformation is prevented. It is believed to be crucial that the rate of heating be slow enough that the samples being treated do not spontaneously cause a spike in the temperature within the furnace, as may occur if some or all the samples spontaneously release heat upon phase transformation, a process known as "recalescence." It is believed that a heating spike due to recalescence can be prevented if, in the case of the SB1 material, the heating rate is controlled to be at or below 0.265° C. per second.

It is also contemplated to apply the principles of another invention made by the applicant of the present application, in combination of the principles of the present invention. The other invention is disclosed in a co-pending patent application Ser. No. 08/673,928, filed Jul. 1, 1996 and entitled "Semi-Hard Magnetic Elements Formed By Annealing And Controlled Oxidation of Soft Magnetic Material."

According to the principles of the other invention, the heating of the material from room temperature up to a suitable temperature or temperatures for annealing, and cooling of the material from the annealing temperature to room temperature, are both performed in the presence of an inert atmosphere, such as pure nitrogen gas. In between these heating and cooling steps, and during heat treatment for the purpose of crystallization, the material is exposed to oxygen for a controlled period of time so that a controlled degree of oxidation occurs. The degree of oxidation is selected to provide an increase in the magnetic flux level provided when the resulting control element is magnetized to saturation.

According to a preferred embodiment which employs the teachings of both this invention and the other invention, the material is heated from room temperature to 485° C. in an inert atmosphere. The inert atmosphere is maintained while pre-annealing is performed for one hour at 485° C. While still maintaining the inert atmosphere, the temperature of the material is raised again to 585° C. and that temperature is maintained for one hour. Then for another one hour period the temperature is maintained at 585° C. while permitting ambient air to enter the furnace to carry out a controlled oxidation stage, which is followed by another hour of treatment at 585° C. in a restored inert atmosphere. The restored inert atmosphere continues to be maintained as the material is heated for further treatment at 710° C. for one hour, and then the material is cooled from 710° to room temperature, still in the inert atmosphere. The resulting material has a coercivity of about 19 Oe.

As another variation, the last hour of heat treatment is performed at 800° C. instead of 710°, to produce a coercivity of about 11 Oe.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. A ribbon-shaped discrete magnetic element formed of an amorphous metalloid that has been annealed so as to be at least partially crystallized and to have a coercivity of at least about 10 Oe, while remaining substantially flat.

2. A ribbon-shaped discrete magnetic element according to claim 1, wherein said metalloid consists substantially exclusively of iron, silicon and boron.

3. A ribbon-shaped discrete magnetic element according to claim 2, having a smallest dimension of about 50.8 microns.

4. A ribbon-shaped discrete magnetic element according to claim 1, having semi-hard magnetic properties.

5. A method of making a magnetic element comprising the steps of:

providing a magnetic element formed of a magnetically soft amorphous metallic material;

first-annealing said amorphous material for at least one hour at a temperature that is below a crystallization temperature of said material; and after said first-annealing step, second-annealing said amorphous material for a time and at a temperature sufficient to crystallize the bulk of the material to give the overall magnetic material semi-hard magnetic properties.

6. A method according to claim 5, wherein said amorphous material consists substantially exclusively of iron, boron and silicon.

7. A method according to claim 6, wherein said first-annealing step is performed at a temperature of more than 450° C.

8. A method according to claim 7, wherein said second-annealing step is performed at a temperature of at least 545° C.

9. A method according to claim 7, wherein said first-annealing step is performed at a temperature in the range of 485°–520° C.

10. A method according to claim 5, wherein said first-annealing step is performed at a temperature of at least 400° C.

11. A method according to claim 5, wherein said first-annealing step is performed in a substantially inert atmosphere.

12. A method of making a magnetic element comprising the steps of:

providing a magnetic element formed of a magnetically soft amorphous metallic material;

heating said amorphous material from room temperature to an annealing temperature that is above a crystallization temperature of said material, said heating being performed such that the rate at which the temperature of said material is increased never exceeds 0.265° C./sec; and annealing said amorphous material at said annealing temperature for a time sufficient to crystallize the bulk of the material to give the overall magnetic material semi-hard magnetic properties.

13. A method according to claim 12, wherein said amorphous material consists substantially exclusively of iron, boron and silicon.

14. A method according to claim 13, wherein said annealing step is carried out at a temperature of at least 545° C.

15. A method according to claim 12, wherein said step of heating said material from room temperature to said annealing temperature is performed in a substantially inert atmosphere.

16. A magnetic element comprising an amorphous magnetically soft iron-metalloid material at least a part of the bulk of which has been crystallized to give the overall magnetic element semi-hard magnetic properties, said amorphous magnetically soft iron-metalloid material having been pre-annealed for at least one hour prior to crystallization, said pre-annealing at a temperature that is below a crystallization temperature of said material.

17. A magnetic element according to claim 16, wherein said pre-annealing was at a temperature of at least 400° C.

18. A magnetic element according to claim 16, consisting substantially exclusively of iron, silicon and boron.

19. A magnetic element according to claim 18, wherein said pre-annealing was at a temperature in excess of 450° C.

20. A magnetic element according to claim 19, wherein said pre-annealing was at a temperature in the range 485°–520° C.

21. A marker for use in an EAS system comprising:

a signal generating first magnetic element having an activated state in which the signal generating first magnetic element is able to interact with an applied magnetic field and a deactivated state in which the signal generating first magnetic element is disabled from interacting with said applied magnetic field; and a second magnetic element disposed adjacent said signal generating first magnetic element for placing said signal generating first magnetic element in said activated and deactivated states, said second magnetic element comprising an amorphous magnetically soft iron-metalloid material at least a part of the bulk of which has been crystallized to give the overall second magnetic element semi-hard magnetic properties, said amorphous magnetically soft iron-metalloid material having been pre-annealed for at least one hour prior to crystallization, said pre-annealing at a temperature that is below a crystallization temperature of said material.

22. A marker according to claim 21, wherein said second magnetic element consists substantially exclusively of iron, silicon and boron.

23. An electronic article surveillance system for detecting the presence of a marker in an interrogation zone, comprising:

a marker including a signal generating first magnetic element having an activated state in which the signal generating first magnetic element is able to interact with an applied magnetic field and a deactivated state in which the signal generating first magnetic element is disabled from interacting with said applied magnetic field and a second magnetic element disposed adjacent said signal generating first magnetic element for placing said signal generating first magnetic element in said activated and deactivated states, said second magnetic element comprising an amorphous magnetically soft iron-metalloid material at least a part of the bulk of which has been crystallized to give the overall second magnetic element semi-hard magnetic properties, said amorphous magnetically soft iron-metalloid material having been pre-annealed for at least one hour prior to crystallization, said pre-annealing at a temperature that is below a crystallization temperature of said material;

means for transmitting said magnetic field into the interrogation zone; and means for receiving a signal resulting from said signal generating first magnetic element of said marker interacting with said magnetic field.

24. An electronic article surveillance system according to claim 23, wherein said second magnetic element consists substantially exclusively of iron, silicon and boron.

25. A method of making a magnetic element comprising the steps of:

providing a magnetic element formed of a magnetically soft amorphous metallic material in the form of a substantially flat planar strip;

first-annealing the strip of amorphous material at a temperature below a crystallization temperature of the material and for a time sufficient to cause a reduction of substantially 0.65 percent in a longitudinal dimension of the strip of amorphous material; and after said first-annealing step, second-annealing said amorphous material for a time and at a temperature sufficient to crystallize the bulk of the material to give the overall magnetic material semi-hard magnetic properties.

26. A method according to claim 25, wherein said amorphous material consists substantially exclusively of iron, boron and silicon.

27. A method according to claim 25, wherein said first-annealing step is performed at a temperature of at least 400° C.

28. A method according to claim 27, wherein said first-annealing step lasts for at least one hour.

* * * * *

UNITED STATES PATENT AND TRADEMARK OFFICE

CERTIFICATE OF CORRECTION

PATENT NO. : 5,870,021

DATED : February 9, 1999

INVENTOR(S) : Dennis Michael Gadonniex

It is certified that error appears in the above-identified patent and that said Letters Patent is hereby corrected as shown below:

Column 2, line 29, delete "6000" and insert –600–.

Signed and Sealed this

Twenty-eighth Day of December, 1999

*Attest:*

Q. TODD DICKINSON

*Attesting Officer*

*Acting Commissioner of Patents and Trademarks*